United States Patent [19]

Skinner

[11] 4,214,564

[45] Jul. 29, 1980

[54] FUEL INJECTION PUMPING APPARATUS

[75] Inventor: Robert T. J. Skinner, High Wycombe, England

[73] Assignee: Lucas Industries Limited, Birmingham, England

[21] Appl. No.: 862,506

[22] Filed: Dec. 20, 1977

[30] Foreign Application Priority Data

Dec. 17, 1976 [GB] United Kingdom ..... 52939/76

[51] Int. Cl.[2] ..... F02D 1/16

[52] U.S. Cl. ..... 123/502; 123/179 L

[58] Field of Search ..... 123/139 AQ, 139 AP, 123/139 ST, 179 L

[56] References Cited

U.S. PATENT DOCUMENTS

| | | | |
|---|---|---|---|
| 3,640,259 | 2/1972 | Garcea | 123/179 L |
| 3,727,598 | 4/1973 | Knapp | 123/179 L |
| 3,943,902 | 3/1976 | Skinner | 123/139 AQ |
| 4,050,433 | 9/1977 | Tokashiki | 123/139 AQ |
| 4,117,821 | 10/1978 | Kawai | 123/179 L |
| 4,122,813 | 10/1978 | Barnert et al. | 123/139 AQ |

FOREIGN PATENT DOCUMENTS

| | | | |
|---|---|---|---|
| 529671 | 11/1940 | United Kingdom | 123/139 ST |
| 1342711 | 1/1974 | United Kingdom | 123/179 L |

*Primary Examiner*—Charles J. Myhre
*Assistant Examiner*—Andrew M. Dolinar

[57] ABSTRACT

A fuel injection pumping apparatus includes an injection pump having a piston which can be subjected to a varying fluid pressure to determine the timing of injection of fuel. Resilient means is provided to bias the piston and a member is provided to act as a stop for the piston. The member is coupled to a temperature responsive device whereby when the engine is cold, the stop determines the position of the piston so that a predetermined timing is obtained for starting the engine. The stop moves when the engine is warm to permit the piston to vary the timing of the apparatus over the full range.

3 Claims, 5 Drawing Figures

FUEL INJECTION PUMPING APPARATUS

This invention relates to a fuel injection pumping apparatus for supplying fuel to internal combustion engines and of the kind comprising an injection pump operable in use, in timed relationship with an associated engine, a feed pump for supplying fuel to the injection pump, valve means for controlling the output pressure of the feed pump so that it varies in accordance with the speed at which the apparatus is driven in use, the injection pump including cam means movable to adjust the timing of delivery of fuel by the injection pump and fluid pressure operable means for adjusting the setting of said cam means, the setting of said fluid pressure operable means being dependent upon the outlet pressure of the feed pump.

Such an apparatus as described is well known in the art and the effect of the fluid pressure operable means is to adjust the timing of delivery of fuel so that the timing advances with increasing speed. Some engines require for correct operation, modification to the timing/advance characteristic and in particular the engine for which the present apparatus is designed requires that when the engine is cold the timing of delivery of fuel should be advanced even at low engine speeds. It is the object of the present invention to provide an apparatus of the kind specified capable of fulfilling the aforesaid requirement.

According to the invention an apparatus of the kind specified comprises a member movable between a first position and a second position, said member when in said first position maintaining said cam means in a position such that the delivery of fuel is advanced, resilient means biasing said member to said first position, a temperature sensitive device responsive in use, to the temperature of the associated engine and means coupling said device and said member whereby as the engine becomes warm the member is moved against the action of the resilient means from the first position to the second position, said cam means when said member is in said second position being free to move under the control of said fluid pressure operable means.

One example of an apparatus in accordance with the invention will now be described with reference to the accompanying drawings in which.

Figure 1:
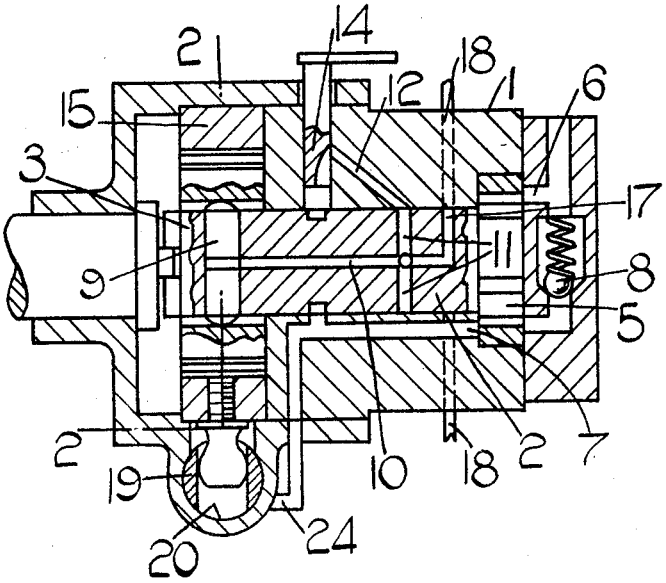
FIG. 1 is a sectional side elevation of the apparatus.
Figure 2:
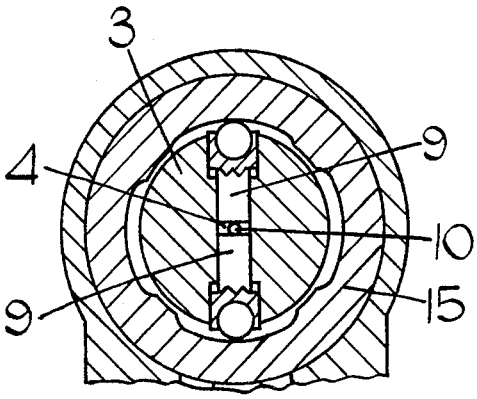
FIG. 2 is a section on the line 2—2 of FIG. 1.

Referring initially to FIGS. 1 and 2 of the drawings, there is provided a body part 1 in which is mounted a rotary cylindrical distributor member 2 having formed at one end a head 3 in which is formed a transverse bore 4 mounting a pair of reciprocable pumping plungers 9. The plungers are arranged to be moved inwardly as the distributor member is rotated, by the action of a plurality of cam lobes which are formed on the internal periphery of an annular cam ring 15 which surrounds the distributor member at this point. The plungers have outer ends which are engageable with shoes which mount rollers, the rollers engaging the internal peripheral surface of the cam ring. The plungers 9 together with the bore in which they are located, the shoes, the rollers and the cam ring with its cam lobes, constitute an injection pump. The distributor 3 in use is driven in timed relationship with an associated engine so that the plungers are moved inwardly also in timed relationship with the engine.

Formed in the distributor member is a longitudinal bore 10 which at one point is in communication with an outwardly extending delivery passage 17 which is arranged to register in turn and as the distributor member rotates, with a plurality of outlet ports 18 which in use are connected to the injection nozzles respectively of the associated engine.

At another point the longitudinal passage is in communication with a plurality of equiangularly disposed and radially extending inlet passages 11 which register in turn as the distributor member rotates, with an inlet port 12 formed in the body part 1. The communication with an inlet passage 11 and the inlet port 12 occurs during the time when the plungers 9 are permitted to move outwardly by the cam lobes and the communication of the delivery passage 17 with one of the outlet ports 18 occurs for the whole of the time the plungers are being moved inwardly.

At the opposite end of the distributor to the transverse bore there is mounted the rotor of a vane type feed pump 5 having an inlet 6 and outlet 7 the latter being formed in the body part. The inlet 6 is formed in a housing which is secured to the body part and in use is connected to a source of liquid fuel. Moreover, located within the housing part is a relief valve which includes a spring loaded ball 8 which is lifted from its seating by the fuel under pressure at the outlet of the pump. The valve controls the outlet pressure of the feed pump so that is varies in accordance with the speed at which the distributor member is driven.

The outlet 7 of the feed pump is in communication with the aforesaid inlet port 12 by way of a passage formed in the body part and in which is located a throttle valve 14 whereby the quantity of fuel which flows through the inlet port 12 whilst the plungers are capable of moving outwardly, can be varied. The throttle valve is shown diagrammatically and it comprises an angularly adjustable cylindrical member the setting of which is controlled by a speed sensitive governor not shown. The governor may be a mechanical governor which includes operator adjustable means whereby the amount of fuel supplied to the engine can be adjusted or it may comprise an hydraulic governor again with operator adjustable means for adjusting the amount of fuel supplied to the engine.

The cam ring 15 is angularly adjustable within the body part about the axis of rotation of the distributor member and in this manner variation in the timing of delivery of fuel to the engine can be effected. For adjusting the setting of the cam ring a fluid pressure operable means in the form of a piston 19 is provided and this is located within a cylinder 20 which is disposed tangentially relative to the cam ring. The piston is connected to the cam ring by means of a radial peg which is secured to the cam ring and which is engaged within a cylindrical recess formed in the piston.

Figure 3:
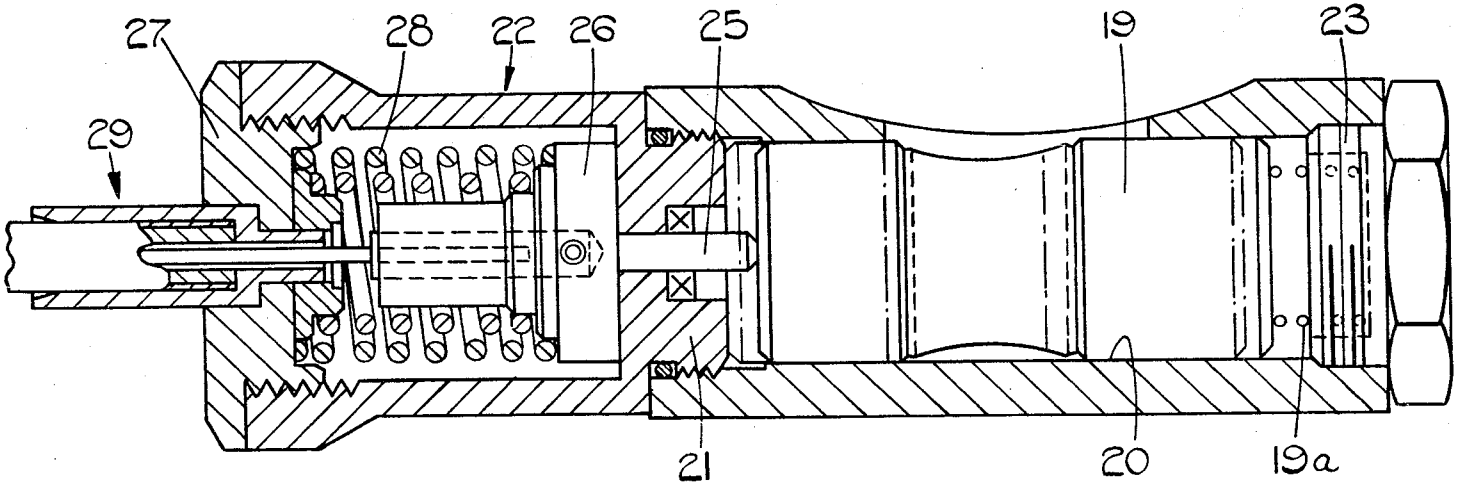
FIG. 3 is a sectional view of part of the apparatus taken at right angles to FIG. 1.

Referring now to FIG. 3. One end of the cylinder 20 containing the piston 19 is closed by an end closure 21 which includes a cup-shaped extension 22. The other end of the cylinder 20 containing the piston 19 is closed by an end closure 23 and located between the closure 23 and the piston 19 is a coiled compression spring. 19*a*. Fuel under pressure from the outlet 7 of the feed pump can be admitted to the space between the piston 19 and the end closure 21. This fuel is supplied by way of a passage 24 and the pressure acting on the piston 19 moves the piston against the action of the coiled compression spring 19*a*. Such movement is towards the right as seen in FIG. 3 and the effect of such movement of the piston is to advance the timing of delivery of fuel by the injection pump.

Slidably mounted within the end closure 21 is an abutment pin 25. The pin 25 extends into the aforesaid space for abutment with the piston 19. The pin carried and forms an extension of a member 26 which is housed in the cup-shaped portion 22. The open end of the cup-shaped portion is closed by a plug 27. and interposed between the plug 27 and the member 26 are a pair of coiled compression springs 28. The springs 28 bias the member 26 together with the abutment pin 25 to a first position and in this position the pin engages the piston 19 and moves it against the action of the spring 19*a* to a position in which the timing of delivery of fuel to the engine is advanced. It should be noted that this is not necessarily the maximum advance which can be obtained when the piston 19 is subjected to the outlet pressure of the feed pump. With the piston 19 in the aforesaid position and indeed as is shown in FIG. 3, even though the engine speed may fall the piston 19 can only move in the direction to retard the timing of delivery of fuel by an amount determined by its abutment with the pin 25.

Once the associated engine has attained its working temperature, it is desirable that the timing should automatically retard as the engine speed falls. It is therefore necessary to move the member 26 and the pin 25 to a second position against the action of the springs 28. For this purpose there is provided a Bowden cable indicated at 29, the cable having an inner component which is connected to the member 26 and an outer component which is housed in a conventional manner, within a ferrule located within the end cap 27. It will be appreciated that if the inner component of the Bowden cable is moved towards the left as seen in FIG. 3, the member 26 will move to its second position.

Also provided is a temperature sensitive means generally indicated at 30. This comprises a housing which is formed in two parts 31, 32 which are secured together by bolts not shown. The housing part 31 mounts a ferrule for the other end of the Bowden cable the inner component of the cable having a nipple secured the reto which is located within a lever 33 pivotally supported on a pin 34. Movement of the lever 33 in an anticlockwise direction about the pivot pin 34 will effect movement of the member 26 to its second position.

Figure 4:
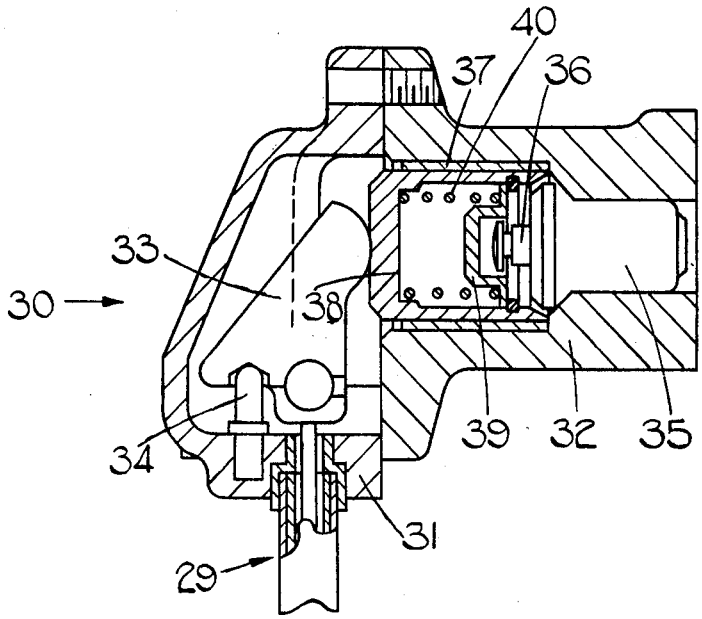
FIG. 4 is a sectional side elevation of another part of the apparatus which in use, is mounted upon the associated engine
Figure 5:
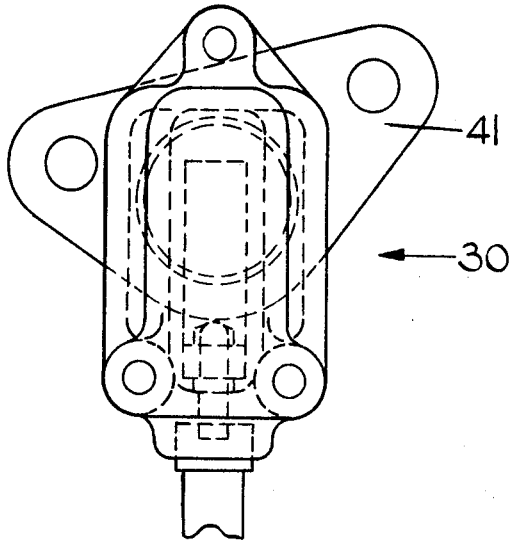
FIG. 5 is an end view of the device seen in FIG. 4.

The housing part 32 is provided with a stepped bore the narrower end of which provides a location for a temperature responsive actuating element 35. This has a body portion which is provided with a peripheral flange located against the step defined in the bore and also a plunger 36 which when the temperature to which the element is subjected, attains a predetermined value moves out of the body portion towards the left as viewed in FIG. 4. Located within the wider portion of the bore is a bush 37 within which is slidably mounted a cup-shaped plunger 38 having its closed end directed towards and in contact with a profile defined on the lever 33.

Within the cup-shaped plunger there is provided a thimble 39 having an outwardly extending flange slidable within the cup-shaped plunger 38. Located between the aforesaid flange and the base wall of the plunger 38 is a coiled compression spring 40 which is pre-loaded, the thimble and the cup-shaped plunger being held in assembly by means of a cir-clip located within a groove formed in the inner wall of the plunger. The head of the plunger 36 is engageable with the thimble and when such engagement occurs the plunger 38 moves towards the left. In so doing it pivots the lever 33 about the pivot point 34 and the member 26 is moved to the second position. It should be noted that when cold there is a clearance between the head of the plunger 36 and the thimble 39 and also that the arrangement of the lever is such that the movement of the member 26 is smaller than that of the plunger 38.

The extent of movement of the member 26 is limited by a stop surface defined by the end cap 27 and the purpose of the spring 37 is to permit further movement of the plunger 36 if no further movement of the member 26 can take place.

As mentioned above the element 35 is responsive to the engine temperature and for this purpose there may be provided on the housing portion 32 a flange such as is indicated at 41, whereby the housing portion 32 can be secured to the structure of the engine. In this manner the housing portion 32 and the element 35 have a sound thermal connection with the structure of the engine. Alternatively the bore in which the element 35 is located may communicate with a coolant passage of the engine.

I claim:

1. A fuel injection pumping apparatus for supplying fuel to an internal combustion engine and of the kind comprising an injection pump operable in use, in timed relationship with an associated engine, a feed pump for supplying fuel to the injection pump, valve means for controlling the output pressure of the feed pump so that it varies in accordance with the speed at which the apparatus is driven in use, the injection pump including cam means movable to adjust the timing of delivery of fuel by the injection pump and a fluid pressure operable piston for adjusting the setting of said cam means resilient means for biasing said piston the setting of said fluid pressure operable piston being dependent upon the outlet pressure of the feed pump, an axially movable pin engageable with said piston between a first position and a second position, said pin when in said first position maintaining said cam means in a position such that the delivery of fuel is advanced, further resilient means biasing said pin to said first position, a temperature sensitive device responsive in use, to the temperature of the associated engine and means operatively coupling said device and said pin comprising a Bowden cable having an inner member and an outer member whereby as the engine becomes warm the pin is moved against the action of the further resilient means from the first position to the second position, said cam means when said pin is in said second position being free to move under the control of said fluid pressure operable piston.

2. A fuel injection pumping apparatus for supplying fuel to an internal combustion engine and of the kind comprising an injection pump operable in use, in timed relationship with an associated engine, a feed pump for supplying fuel to the injection pump, valve means for controlling the output pressure of the feed pump so that it varies in accordance with the speed at which the apparatus is driven in use, the injection pump including cam means movable to adjust the timing of delivery of fuel by the injection pump and a fluid pressure operable piston for adjusting the setting of said cam means and resilient means for biasing said piston the setting of said fluid pressure operable means being dependent upon the outlet pressure of the feed pump, an axially movable pin engagable with said piston between a first position and a second position, said pin when in said first position maintaining said cam means in a position such that the delivery of fuel is advanced, further resilient means biasing said pin to said first position, a temperature sensitive device responsive in use, to the temperature of the associated engine and means operatively coupling said device and said pin comprising a Bowden cable having an inner member and outer member whereby as the engine becomes warm the pin is moved against the action of the further resilient means from the first position to the second position, said cam means when said pin is in said second position being free to move under the control of said fluid pressure operable piston, said device including a housing, a temperature responsive element in the housing, said element having a movable plunger which moves upon an increase in temperature, relative to a body portion, and a lever carried in the housing, said lever being connected to the inner member of the Bowden cable, and being engageable by a part positioned between said movable plunger and said lever.

3. An apparatus according to claim 2 in which said part includes a preloaded spring.

* * * * *